US007750229B2

(12) United States Patent
Lindemann

(10) Patent No.: US 7,750,229 B2
(45) Date of Patent: Jul. 6, 2010

(54) SOUND SYNTHESIS BY COMBINING A SLOWLY VARYING UNDERLYING SPECTRUM, PITCH AND LOUDNESS WITH QUICKER VARYING SPECTRAL, PITCH AND LOUDNESS FLUCTUATIONS

(76) Inventor: Eric Lindemann, 2975 18th St., Boulder, CO (US) 80304

( * ) Notice: Subject to any disclaimer, the term of this patent is extended or adjusted under 35 U.S.C. 154(b) by 631 days.

(21) Appl. No.: 11/637,596

(22) Filed: Dec. 12, 2006

(65) Prior Publication Data

US 2007/0137466 A1 Jun. 21, 2007

Related U.S. Application Data

(60) Provisional application No. 60/751,094, filed on Dec. 16, 2005.

(51) Int. Cl.

| | |
|---|---|
| ***G10H 1/02*** | (2006.01) |
| ***G10H 1/04*** | (2006.01) |
| ***G10H 1/06*** | (2006.01) |
| ***G10H 1/12*** | (2006.01) |
| ***G10H 1/46*** | (2006.01) |
| ***G10H 5/02*** | (2006.01) |
| ***G10H 7/00*** | (2006.01) |

(52) U.S. Cl. ..... 84/626; 84/602; 84/604; 84/609; 84/623; 84/624; 84/627; 84/628; 84/633; 84/659; 84/661

(58) Field of Classification Search ..... 84/659, 84/626, 602, 604, 609, 622, 623, 624, 627, 84/628, 633, 661

See application file for complete search history.

(56) References Cited

U.S. PATENT DOCUMENTS 4,321,427 A * 3/1982 Singh ..... 73/585
4,700,393 A * 10/1987 Masuzawa et al. ..... 704/503
4,998,960 A * 3/1991 Rose et al. ..... 84/622
5,744,742 A * 4/1998 Lindemann et al. ..... 84/623
5,781,696 A * 7/1998 Oh et al. ..... 704/270
6,111,183 A * 8/2000 Lindemann ..... 84/633
6,298,322 B1 10/2001 Lindemann
6,316,710 B1 * 11/2001 Lindemann ..... 84/609

* cited by examiner

*Primary Examiner*—Jeffrey Donels
*Assistant Examiner*—Christina Russell
(74) *Attorney, Agent, or Firm*—Jennifer L. Bales; Macheledt Bales LLP

(57) ABSTRACT

The present synthesizer generates an underlying spectrum, pitch and loudness for a sound to be synthesized, and then combines the underlying spectrum, pitch and loudness with stored Spectral, Pitch, and Loudness Fluctuations and noise elements. The input to the synthesizer is typically a MIDI stream. A MIDI preprocess block processes the MIDI input and generates the signals needed by the synthesizer to generate output sound phrases. The synthesizer comprises a harmonic synthesizer block (which generates an output representing the tonal audio portion of the output sound), an Underlying Spectrum, Pitch, and Loudness (which takes pitch and loudness and uses stored algorithms to generate the slowly varying portion of the output sound) and a Spectral, Pitch, and Loudness Fluctuation portion (which generates the quickly varying portion of the output sound by selecting and combining Spectral, Pitch, and Loudness Fluctuation segments stored in a database). A specialized analysis process is used to derive the formulas used by the Underlying Spectrum, Pitch, and Loudness and to generate and store the Spectral, Pitch, and Loudness Fluctuation segments stored in the database.

18 Claims, 5 Drawing Sheets

SOUND SYNTHESIS BY COMBINING A SLOWLY VARYING UNDERLYING SPECTRUM, PITCH AND LOUDNESS WITH QUICKER VARYING SPECTRAL, PITCH AND LOUDNESS FLUCTUATIONS

The following patents and applications are incorporated herein by reference: U.S. Pat. No. 5,744,742, issued Apr. 28, 1998 entitled "Parametric Signal Modeling Musical Synthesizer;" U.S. Pat. No. 6,111,183, issued Aug. 29, 2000 entitled "Audio Signal Synthesis System Based on Probabilistic Estimation of Time-Varying Spectra;" U.S. Pat. No. 6,298,322, issued Oct. 2, 2001 and entitled "Encoding and Synthesis of Tonal Audio Signals Using Dominant Sinusoids and a Vector-Quantized Residual Tonal Signal;" U.S. Pat. No. 6,316,710, issued Nov. 13, 2001 and entitled "Musical Synthesizer Capable of Expressive Phrasing;" U.S. patent application Ser. No. 11/342,781, filed Jan. 30, 2006 by the present inventor; and U.S. patent application Ser. No. 11/334,014, filed Jan. 18, 2006 by the present inventor.

This application claims the benefit of Provisional Application for Patent Ser. No. 60/751,094 filed Dec. 16, 2005.

FIELD OF THE INVENTION

This invention relates to a method of synthesizing sound, in particular music, wherein an underlying spectrum, pitch and loudness for a sound is generated, and is then combined with stored spectral, pitch and loudness fluctuations and noise elements.

BACKGROUND OF THE INVENTION

Music synthesis generally operates by taking a control stream input such as a MIDI stream and generating sound associated with that input. MIDI inputs include program change, which selects the instrument to play, note pitch, note velocity, and continuous controllers such as pitch-bend, modulation, volume, and expression. Note velocity and volume (or expression) are indicators of loudness.

All music needs time-varying elements such as attack transients and vibrato to sound natural. An expressive musical synthesizer needs a way to control various aspects of these time-varying elements. An example is the amount of attack transient or the vibrato depth and speed.

A common method of generating realistic sounds is sampling synthesis. Conventional sampling synthesizers use one of two methods to incorporate vibrato. The first sort of method stores a number of recorded sound segments, or notes, that include vibrato in the original recording. Every time the same note is played by such a synthesizer, the vibrato sounds exactly the same because it is part of the recording. This repetitiveness sounds artificial to listeners. The second sort of method stores a number of sound segments without vibrato, and then superimposes artificial amplitude or frequency modulation on top of the segments as they are played back. This method still does not sound natural because the artificial vibrato lacks the complexity of the natural vibrato.

In recent years, synthesizers have adopted more sophisticated methods to add time-varying elements such as transients and vibrato to synthesized music.

U.S. Pat. No. 6,31 6,710 to Lindemann describes a synthesis method which stores segments of recorded sounds, particularly including transitions between musical notes, as well as attack, sustain and release segments. These segments are sequenced and combined to form an output signal. U.S. Pat. No. 6,298,322 to Lindemann describes a synthesis method which uses dominant sinusoids combined with a vector-quantized residual signal. U.S. Pat. No. 6,111,183 to Lindemann describes a synthesizer which models the time-varying spectrum of the synthesized signal based on a probabilistic estimation conditioned to time-varying pitch and loudness inputs. Provisional Application for Patent Ser. No 60/644,598, filed Jan. 18, 2005 by the present inventor describes a method for modeling tonal sounds via critical band additive synthesis.

A need remains in the art for improved methods and apparatus for synthesizing sound in which time-varying elements such as attack transients and vibrato can be controlled in an expressive and realistic manner.

SUMMARY OF THE INVENTION

Accordingly, an object of the present invention is to provide improved methods and apparatus for synthesizing sound in which time-varying elements such as attack transients and vibrato can be controlled in an expressive and realistic manner. The method of the present invention generates underlying spectrum, pitch and loudness for a sound to be synthesized, and then combines this slowly varying underlying spectrum, pitch and loudness with stored quickly varying spectral, pitch and loudness fluctuations.

The input to the synthesizer is typically a MIDI stream, comprising at least program change to select the desired instrument (if the synthesizer synthesizes more than one instrument), the note pitch and time-varying loudness in the form of note velocity and/or continuous volume or expression control. A MIDI Preprocess Block processes the MIDI input and generates the signals needed by the synthesizer to generate output sound. The synthesizer comprises a Harmonic Synthesizer Block, an Underlying Spectrum, Pitch, and Loudness Block and a Spectral, Pitch and Loudness Fluctuation Block.

The Underlying Spectrum, Pitch and Loudness Block generates the slowly-varying spectrum, pitch and loudness portion of the sound. It takes pitch and loudness (along with the selected instrument) and utilizes stored algorithms to generate the slowly varying underlying spectrum, pitch and loudness of the output sound.

The Spectral, Pitch and Loudness Fluctuation Block generates the quickly-varying spectrum, pitch and loudness portion of the output sound by selecting, modifying and combining spectral, pitch, and loudness fluctuation segments stored in a database. Signals from the MIDI Preprocessor Block are used to select particular spectral, pitch and loudness fluctuation segments. These spectral, pitch and loudness fluctuation segments describe the quickly-varying spectrum, pitch and loudness of short sections of musical phrases or "phrase fragments". These phrase fragments may correspond to the transition between two notes, the attack of a note, the release of a note, or the sustain portion of a note. The spectral, pitch and loudness fluctuation segments are then modified and spliced together to form the quickly-varying portion of the output spectrum, pitch and loudness. Spectral, pitch and loudness fluctuation segments may be modified (for example, by stretching or compressing in time, or by pitch shifting) according to control signals from the MIDI Preprocessor Block.

A specialized analysis process is used to derive parameters for the stored algorithms used by the Underlying Spectrum, Pitch and Loudness Block. The analysis process also calculates and stores the quickly varying spectral, pitch and loudness fluctuation segments in the database. The process begins with a variety of recorded idiomatic instrumental musical phrases which are represented as a standard digital recording in the time domain. For a given recorded phrase the time-varying pitch envelope, the time-varying power spectrum, and the time-varying loudness envelope are determined. The next step determines the spectral power at harmonics based on the pitch and power spectrum. The spectral power at harmonics is represented as time-varying harmonic amplitude envelopes - one for each harmonic. Each one of these time-varying harmonic envelopes, as well as the time-varying pitch and loudness envelopes can be viewed as a time-varying signal with "modulation" energy in the approximate range 0-100 Hz. Each one of these time-varying envelopes is put through a band-splitting filter that separates it into two envelopes: a low-pass envelope with energy from approximately 0-4 Hz and a high-pass envelope with energy from 5-100 Hz. The low-pass envelopes are used in finding the parameters for the stored algorithms in the Underlying Spectrum, Pitch, and Loudness Block. The high-pass envelopes represent the quickly varying spectral fluctuations that are divided into segments by time and stored in the database used by the Spectral, Pitch, and Loudness Fluctuation Block.

DETAILED DESCRIPTION OF THE INVENTION

Figure 1:
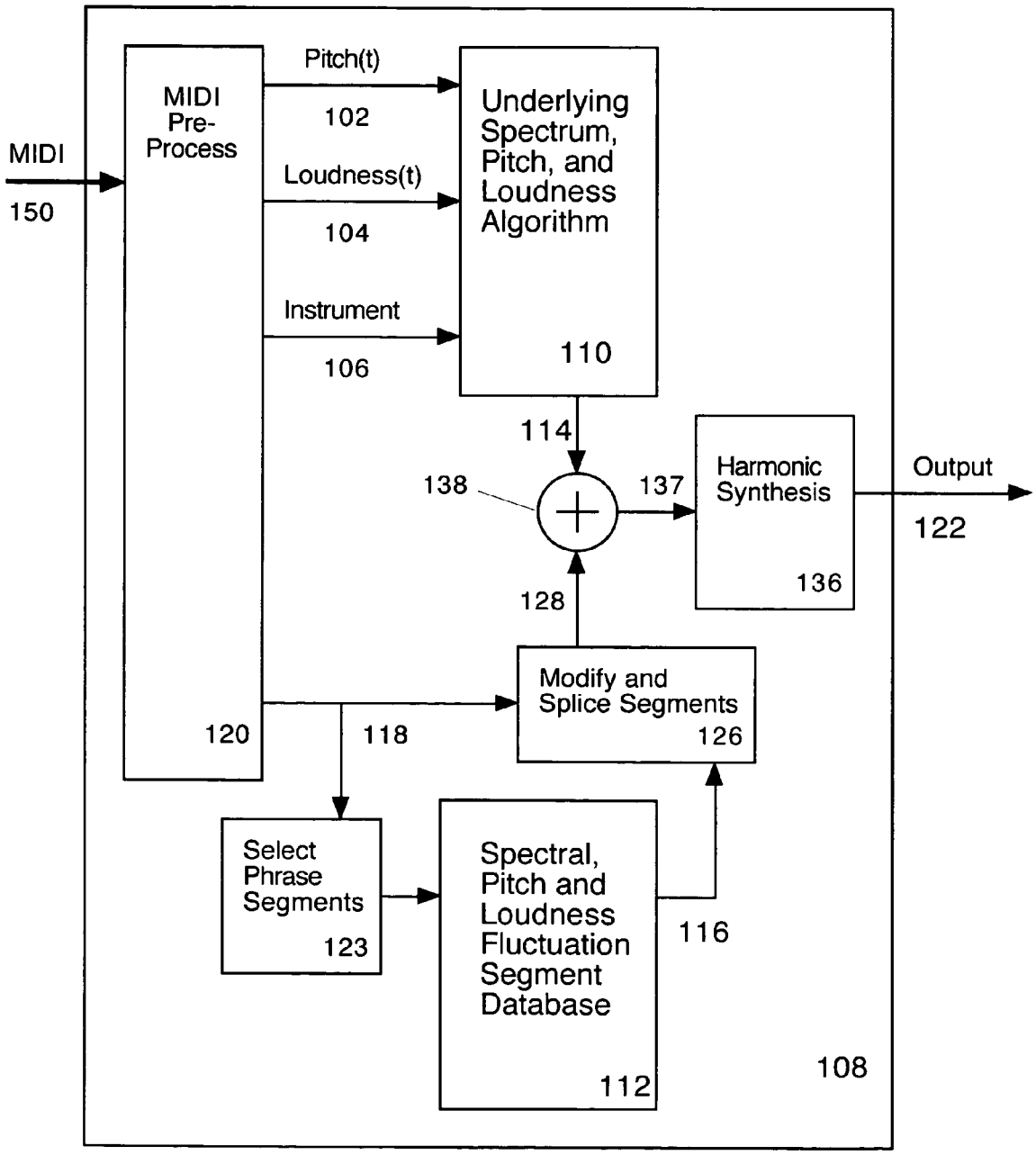
FIG. 1 is a block diagram showing a first embodiment of a sound synthesizing system according to the present invention

FIG. 1 is a block diagram showing a first embodiment of a sound synthesizing system 108 according to the present invention. The input to the synthesizer is typically a MIDI stream 150, comprising at least program change to select desired instrument (if the synthesizer synthesizes more than one instrument), the note pitch, and time-varying loudness in the form of note velocity and/or continuous volume or expression controls, and modulation controls to control vibrato depth and/or vibrato speed. MIDI Preprocess Block 120 processes the input 150 and generates the signals needed by synthesizer 108 to generate sound. MIDI Preprocess Block 120 is illustrated in more detail in FIG. 3.

Harmonic Synthesis Block 136 combines outputs from other parts of the synthesizer 108 and generates the final sound output 122. Harmonic Synthesis 136 is a well-known process in the field of music synthesis and is not described here in detail. One example of a method for harmonic synthesis is described in Provisional Application for Patent Ser. No. 60/644,598, filed Jan. 18, 2005 by the present inventor, and incorporated herein by reference. U.S. Pat. No. 6,298,322 to Lindemann describes another harmonic synthesis method which uses dominant sinusoids combined with a vector-quantized residual signal that codes high frequency components of the signal. It is obvious to one skilled in the art of music synthesizer design that there are many ways to accomplish harmonic synthesis. The method chosen does not affect the character of the present invention.

Underlying Spectrum, Pitch, and Loudness Block 110 takes pitch 102 and loudness 104 (along with instrument 106) and generates the slowly varying portion of output sound spectrum, pitch, and loudness 114.

Figure 2:
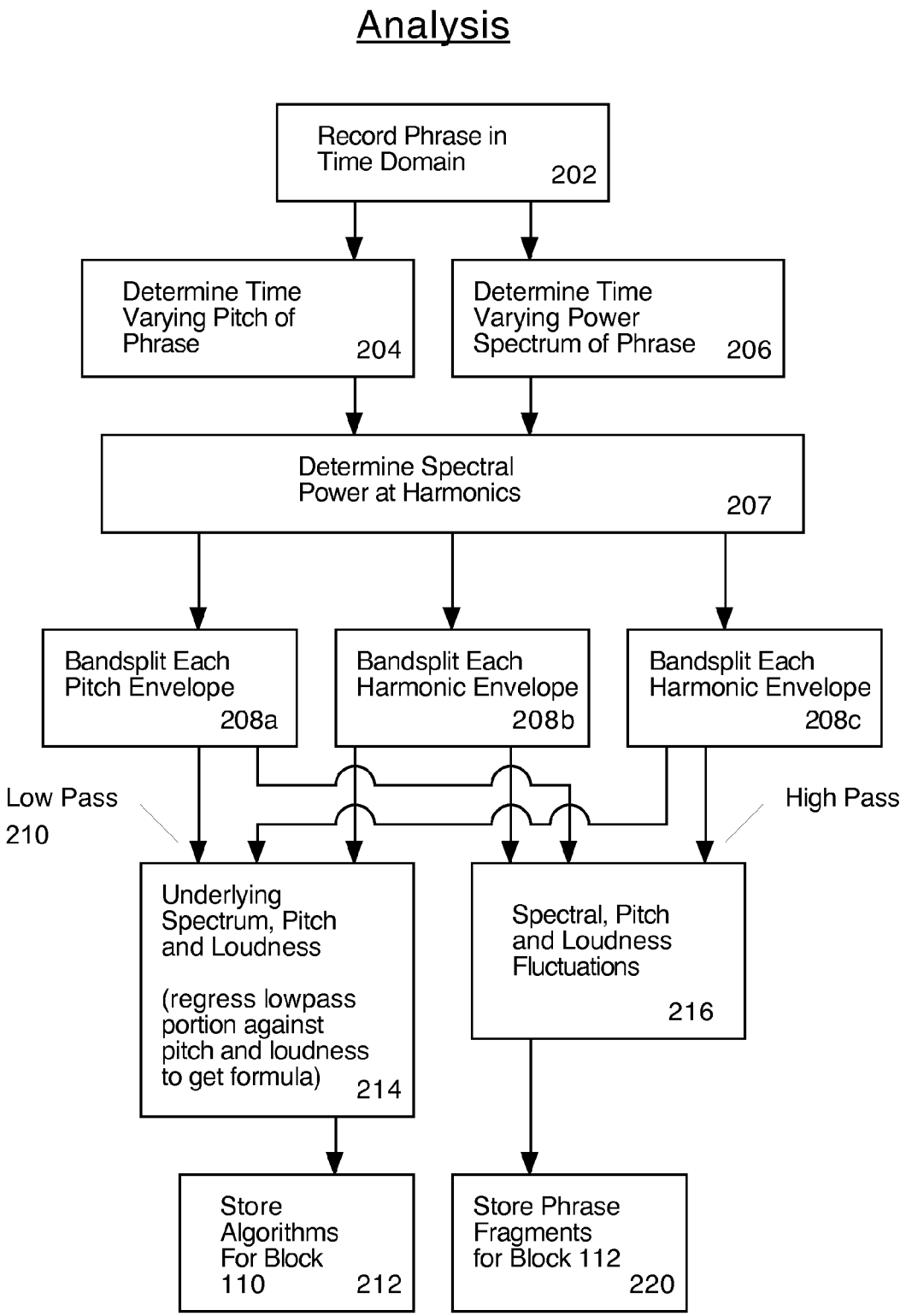
FIG. 2 is a block diagram illustrating how recorded music segments are analyzed to create the parameters for the Underlying Spectrum, Pitch, and Loudness Block.

The quickly varying spectrum, pitch, and loudness portion 128 of the output sound is generated by selecting (in block 123) and combining (in block 126) spectral, pitch, and loudness fluctuation segments stored in a database 112. FIG. 2 illustrates how these stored segments are derived from analysis of recorded notes and phrases. Phrase Descriptor Parameters 118 (shown in FIG. 3) are used to select particular segments 116. Segments 116 are spliced together by block 126. Block 126 may also modify segments 116 according to control signals 118, better shown in FIG. 3. These modifications may include modifying the amplitude of the quickly-varying spectral, pitch, and loudness fluctuation segments, modifying the speed of the fluctuations, stretching or compressing the segments in time, or pitch shifting all or part of the segments.

The slow-varying portion of the spectrum, pitch and loudness 114 generated by block 110 and the quickly varying portion of the spectrum, pitch and loudness 128 are combined by adder 138 to form the complete time-varying spectrum, pitch and loudness which is converted to an output audio signal 122 by Harmonic Synthesis 136.

FIG. 2 is a flow diagram illustrating how recorded musical phrases 202 are analyzed to create parameters for algorithms 212 for generating the slowly-varying underlying spectrum 114 and for generating the database of spectral, pitch, and loudness fluctuation segments 112. This flow diagram is somewhat high level, as those in the field of sound synthesis will appreciate that there are a number of ways of accomplishing many of the steps. The processes accomplished in the first half of the diagram (steps 202, 204, 206, and 207) are well known. An example is shown and described in detail in U.S. Pat. No. 6,111,183 to Lindemann, issued Aug. 29, 2000 entitled "Audio Signal Synthesis System Based on Probabilistic Estimation of Time-Varying Spectra" and incorporated herein by reference. See especially FIG. 5 and associated text. The processes accomplished in the second half of the diagram (steps 208*a*-220) are specific to the present invention and hence are described in more detail.

Analysis begins with recorded phrases in the time domain 202. Various idiomatic natural musical phrases are recorded that would include a variety of note transition types, attacks, releases, and sustains, across the pitch and intensity range of the instrument. In general these recordings are actual musical phrases, not isolated notes as would be found in a traditional sample library. A good description of recorded phrase segments (though they are used in a different context) is found in U.S. Pat. No. 6,316,710 to Lindemann, issued Nov. 13, 2001 and entitled "Musical Synthesizer Capable of Expressive Phrasing" and incorporated herein by reference. See especially FIGS. 1 and 2 and associated text.

For a given recorded phrase 202 it is necessary to determine the time-varying pitch envelope 204 and the time-varying power spectrum 206. Block 207 determines the spectral power at harmonics based on the pitch and power spectrum. The spectral power at harmonics is represented as time-varying harmonic amplitude envelopes—one for each harmonic. Each one of these time-varying envelopes can be viewed as a time-varying signal with "modulation" energy in the approximate range 0-100 Hz. Each one of these harmonic envelopes is put through a band-splitting filter 208*a*, 208*b*, 208*c* that separates it into two envelopes: a low-pass envelope with energy from approximately 0-4 Hz and a high-pass envelope with energy from 5-100 Hz. The low-pass envelopes 210 are used in finding the parameters for the stored algorithms in 110 in FIG. 1. The high-pass harmonic envelopes 216 represent the quickly varying spectral, pitch, and loudness fluctuations that are divided into segments by time and stored in the database 112 of FIG. 1.

The Underlying Spectrum Analysis Block 214 derives the parameters to be utilized by the stored algorithms of the Underlying Spectrum, Pitch, and Loudness Block 110 to generate the underlying envelopes. In synthesis the underlying pitch and loudness envelopes are essentially the same as the input pitch and loudness controls generated by MIDI Pre-Process 120 of FIG. 1.

Figure 4:
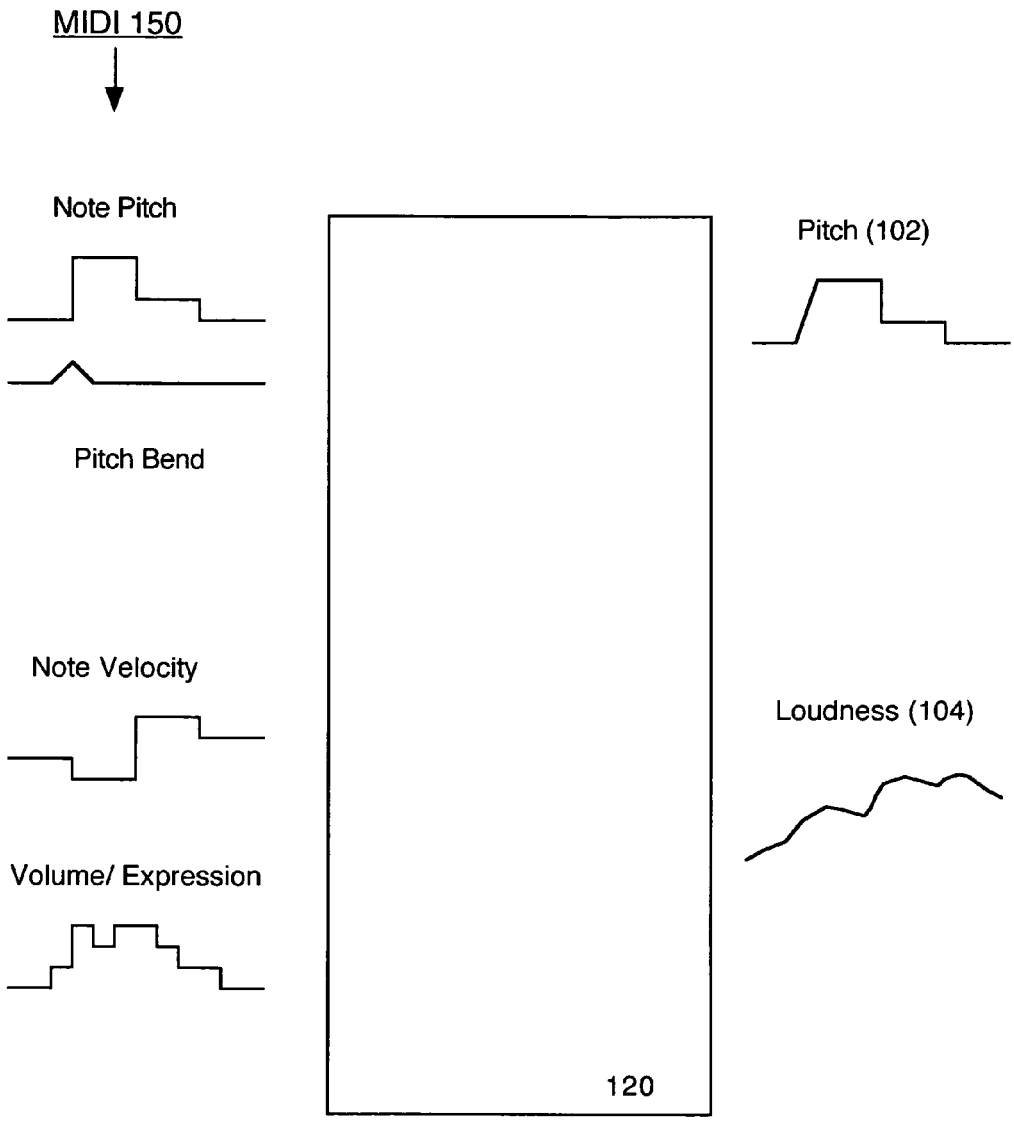
FIG. 4 is a flow diagram showing how the slowly-varying underlying spectrum, pitch and loudness are generated in the Underlying Spectrum, Pitch, and Loudness Block.

These are in turn generated simply from input MIDI pitch note pitch, note velocity and expression/volume controls as described further on and in FIG. 4.

The Underlying Spectrum is generated from the stored algorithms 214 which take the underlying pitch and loudness as inputs and generated slowly time-varying spectra based on these inputs.

In order to generate the Underlying Spectrum the algorithms use parameters that are stored along with the algorithms in 214 and 212 and used by block 110. In one embodiment of the present invention these parameters represent regression parameters conditioned on pitch and loudness. That is, the values of each harmonic envelope are regressed against the values of the underlying pitch and loudness envelopes so that a conditional mean, conditioned on pitch and loudness, is determined for each harmonic. There is a set of regression parameters associated with each harmonic. Therefore, for the Nth harmonic it is possible to say what is the conditional mean value for this harmonic given particular values of pitch and loudness. It also possible to perform a "vectorized" regression in which all of the envelopes are collectively regressed against pitch and loudness as part of one matrix operation, yielding a single set of "vectorized" regression parameters covering all harmonics. Often a simple linear regression based on pitch and loudness can be used but it will be obvious to those skilled in the art of statistical learning theory that many methods exist for this kind of regression and prediction. These methods include neural networks, bayesian networks, support vector machines, etc. The character of the present invention does not depend on any particular regression or prediction method. Any method which gives a reasonable value for the Nth harmonic given pitch and loudness is appropriate. Specific techniques and details regarding this kind of "spectral prediction" are given in U.S. Pat. No. 6,111,183 to Lindemann, issued Aug. 29, 2000 entitled "Audio Signal Synthesis System Based on Probabilistic Estimation of Time-Varying Spectra" and incorporated herein by reference. During synthesis the Underlying Spectrum, Pitch, and Loudness 110 for FIG. 1 then takes as input time-varying pitch and loudness and for every harmonic (or a vectorized value for all harmonics) calculates a time-varying conditional mean value using the regression parameters determined in the analysis process. The time-varying conditional mean(s) for the harmonics is Underlying Spectrum 114 output by block 110.

The high-pass signal 216 represents the quickly varying spectral, pitch and loudness fluctuations of the recorded phrase. It is stored as Spectral, Pitch, and Loudness Fluctuation segments in database 112 of FIG. 1.

Storing the phrase fragments 220 representing only the quickly varying spectral, pitch and loudness fluctuations of the phrase has numerous advantages. The fragments 220 can be used over a large range of pitch and loudness, because the overall tone of the phrase is provided separately, as underlying spectrum, pitch and loudness 114. Fragments 220 may also be spliced together without careful interpolation, as discontinuities at splice points tend to be small compared to the overall signal. Most importantly, the Spectral, Pitch, and Loudness Fluctuations can be modified in interesting ways. The amplitude of the fluctuations can be scaled with a simple gain parameter. This gives, for example, a very natural vibrato depth control. In the vibrato of a natural instrument the Spectral, Pitch, and Loudness Fluctuations are quite complex. While the vibrato sounds like it has a simple periodicity—e.g. 6 Hz—in fact many of the harmonic amplitude envelopes vibrate at rates different from this: some at 12 Hz, some at 6 Hz, some fairly chaotically with no obvious period. By scaling the amplitude of these fluctuations the intensity of the vibrato is changed while the complexity of the vibrating pattern is preserved. Likewise the speed of the vibrato can be altered by reading out the fluctuations at a variable rate, faster or slower than the original. This modifies the perceived speed of the vibrato while preserving the complexity of the harmonic fluctuation pattern. The pitch of the synthesized phrase can be modified by changing the underlying pitch envelope without changing the time-varying characteristics of the spectral, pitch or loudness fluctuations. The underlying loudness can be changed in a similar fashion. Of course due to the regression parameters the underlying spectrum will change smoothly with changes in underlying pitch and loudness, just as in a natural instrument.

Figure 3:
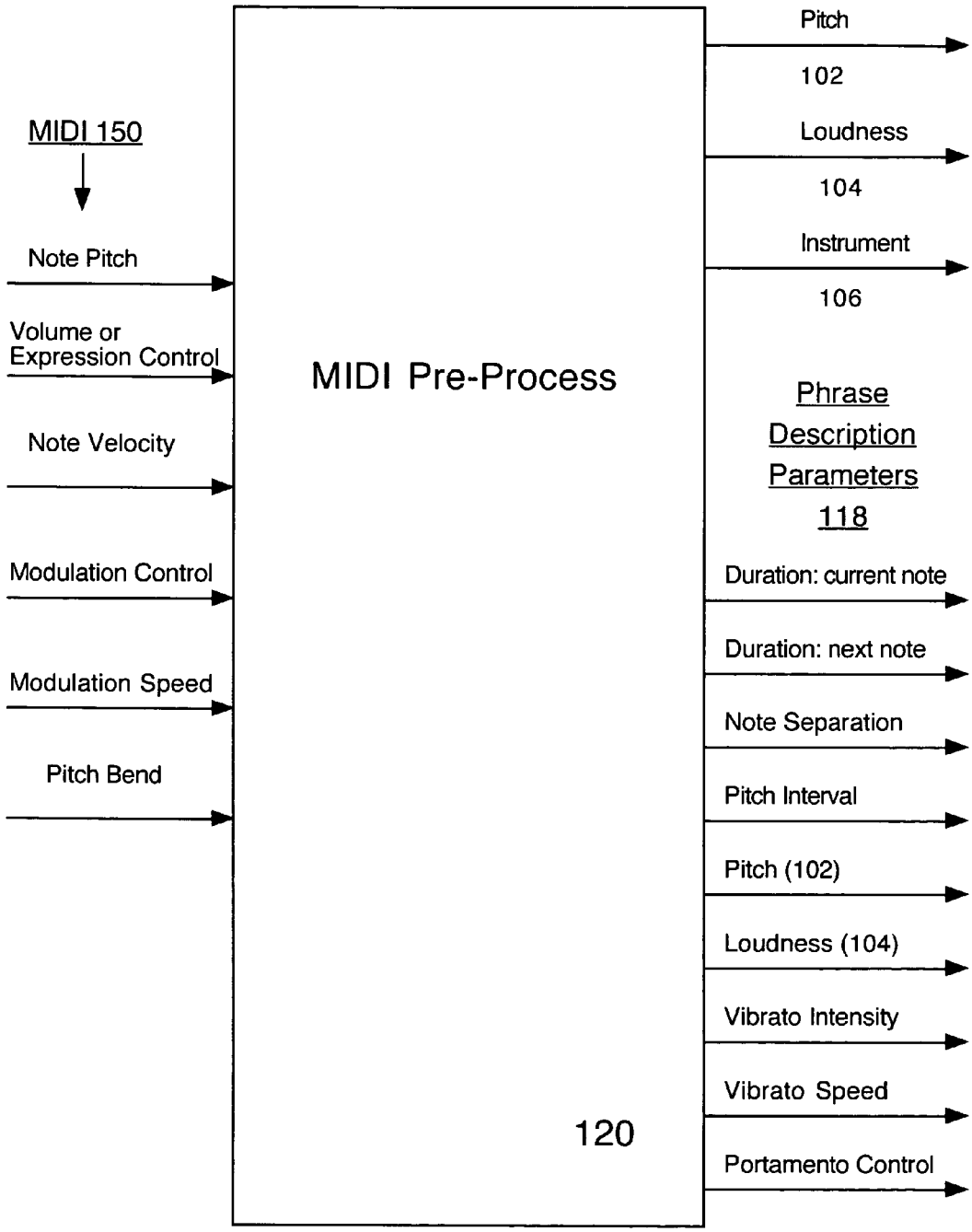
FIG. 3 is a flow diagram showing how the MIDI input control stream is processed for use by the synthesizer.

FIG. 3 is a flow diagram showing how the MIDI input signal is processed for use by the synthesizer. MIDI preprocess block 120 is an example showing the kind of input MIDI signals which can be useful as inputs to a synthesizer 108, and the kind of signals which may be generated for use within synthesizer 108 of FIG. 1. Pre-process block 120 may be either more or less complicated, depending upon the requirements and capacities of the synthesizer processing and data storage.

In the example of FIG. 3, the MIDI inputs 150 comprise several time-varying signals: note pitch, volume or expression, note velocity, modulation control, modulation speed, and pitch bend. These are standard MIDI inputs and are discussed in detail in various places. For example, see U.S. Pat. No. 6,316,710, especially the text associated with FIG. 3, describing the input musical control sequence $C_{in}(t)$.

The inputs to the Underlying Spectrum, Pitch, and Loudness Block 110 of FIG. 1 (pitch 102, loudness 104 and instrument 106) have been discussed. Phrase. description parameters 118 are the inputs to the Select Phrase Segments Block 123 of FIG. 1 and are also inputs to the Modify and Splice Segments Block 126 of FIG. 1. Phrase description parameters 118 include such signals as note duration of the current and next note, note separation time, pitch interval, and pitch 102 and loudness 104. Vibrato intensity, vibrato speed and portamento control may also be provided. These signals are used to select segments from database 112 and also to determine the best places to splice segments and what modification to apply to segments in block 126 of FIG. 1. U.S. Pat. No. 6,316,710 to Lindemann, issued Nov. 13, 2001 and entitled "Musical Synthesizer Capable of Expressive Phrasing" and incorporated herein by reference has detailed description of methods for performing this selection, splicing and modification of segments FIG. 4 is a flow diagram showing how the underlying pitch 102 and loudness 104 are generated from input MIDI note pitch, MIDI note velocity, MIDI volume or expression, and perhaps MIDI Pitch Bend from MIDI stream 150 inside the MIDI Preprocess block 120. For pitch, this is a simple "zero-order hold" filter which means that the value of the MIDI note pitch is held throughout the note. As a result the output pitch 102 appears identical to the input MIDI note pitch. When pitch-bend is present the stair-step may be modified to have a smoothly rising or falling contour near one of the note transitions. A useful discussion of pitch bend is given in U.S. Provisional Patent Application 60/649,053, filed Jan. 29, 2005 by the present inventor and entitled "Musical Synthesizer With Expressive Portamento Controlled by Pitch Wheel Control." The loudness signal is a smoothed combination of input MIDI note-velocity and MIDI volume/expression. First, the velocity is subject to another "zero-order hold filter" similar to the pitch resulting in a stair-step identical to the input drawing of MIDI Note Velocity. Then the volume/expression MIDI continuous control is smoothed through a simple smoothing filter—e.g. a one-pole filter with coefficient in the range 0.9 to 0.99. Then the stair step velocity and smoothed volume/expression are combined. In one embodiment this combination takes the form:

loudness=(stair_step_velocity+smoothed_volume_-expression)/2.

In another embodiment the weighting between the velocity and volume/expression in the above equation is modified throughout the duration of the note so that as the note progresses the velocity component is weighted less and less and the volume_expression component is weighted more and more. The character of the present invention does not depend on any particular method for generating loudness from velocity and/or volume/expression. The Underlying Spectrum, Pitch, and Loudness Block 110 of FIG. 1 applies a set of formulas to the newly generated pitch 102 and loudness 104 to generate the underlying spectrum. The underlying spectrum, pitch and loudness are all included in outputs 114. The Underlying Spectrum, Pitch and Loudness Outputs 114 comprise smoothly varying, continuous signals that have a slowly varying pitch and loudness, and a slowing varying spectrum appropriate to the desired output signal. However, these underlying signals lack the higher frequency—4-100 Hz—spectral, pitch and loudness variations that will add interest and authenticity to the final synthesized output 122.

Figure 5:
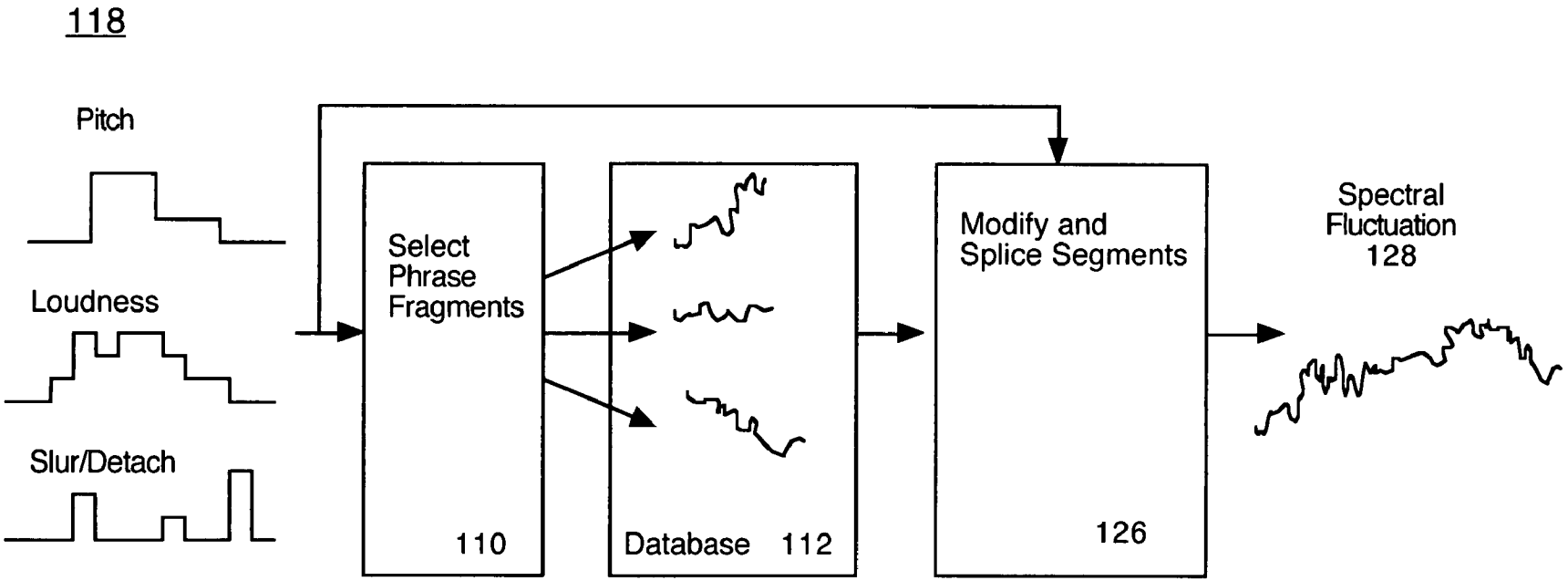
FIG. 5 is a flow diagram showing how the quickly-varying spectral, pitch, and loudness fluctuation segments are selected, combined, and processed in the Spectral, Pitch, and Loudness Fluctuation Block.

FIG. 5 is a flow diagram showing how the spectral, pitch, and loudness fluctuations are selected, combined, and processed. Note that the spectral, pitch, and loudness fluctuations 128 are added 138 to the underlying spectrum, pitch and loudness signal 114 and the combined spectrum, pitch, and loudness 137 are input to the Harmonic Synthesis block 136 for conversion to the final audio output 122.

Phrase description parameters 118, for example pitch 102, loudness 104 and note separation are used by block 123 to determine appropriate fluctuation phrase fragments. For example, a slur transition from a lower note middle C with long duration to an E two notes higher with long notes duration is used to select a phrase fragment with similar characteristics. However, in general the Spectral, Pitch and Loudness Fluctuation Database 112 will not generally contain exactly the desired phrase fragment. Something similar will be found and modified to fit the desired output. The modifications include pitch shifting, intensity shifting and changing durations. Note that Database 112 contains only fluctuations which are added to the final underlying spectrum, pitch, and loudness, and these fragments are highly tolerant to large modifications. For example a fragment from the database can be used over a much wider pitch range—e.g. one octave—compared to a traditional recorded sample from a sample library which may be used over only 2-3 half-steps before the timbre is too distorted and artificial sounding. This ability to reuse fragments over a wide range of pitch, loudness, and duration contributes to the relatively small size of the Database 112 compared with a traditional sample library. U.S. Pat. No. 6,316,710 to Lindemann, issued Nov. 13, 2001 and entitled "Musical Synthesizer Capable of Expressive Phrasing" and incorporated herein by reference give detailed embodiments describing the operations for selecting phrase segments in block 123.

Block 126 modifies and splices the segments from database 112. Phrase Description Parameters 118 are also used in this process. Splicing is accomplished in one embodiment by simple concatenation of spectral, pitch and loudness fluctuation segments fetched from database 112. In another embodiment the segments fetched from database 112 overlap in time so that the end of one segment can be cross-faded with the beginning of the next segment. Note that these segments consist of sequences of spectral, pitch, and loudness parameters so that cross-fading introduces no timbral or phase distortions such as those that occur when cross-fading time-domain audio signals.

The pitch of the output audio signal 122 is generated by Pitch 102 output from 120 through Harmonic Synthesis 136. Only pitch fluctuations, such as the pitch changes associated with vibrato are incorporated in 116. These fluctuations are negative and positive deviations from the mean value where the mean is provided by the Underlying Spectrum, Pitch and Loudness block 110 and incorporated in signals 114. Therefore the mean of the pitch signal in 128 is zero. To affect the vibrato intensity or the intensity of fluctuations associated with an attack it is sufficient to multiply the pitch fluctuation signal in 116 by an amplitude scalar gain value. This is done in 126 in response to vibrato and other controls included in 118. The vibrato and transient fluctuation intensity of loudness and spectral fluctuations are modified in a similar way in 126 according to control signals 118.

It may be that a segment selected from database 112 is not long enough for a desired note output. In one embodiment of the present invention the length of segments corresponding to note sustains is modified by repeating small sections of the middle part of the sustain segment. This can be a simple looped repetition of the same section of the sustain or a more elaborated randomized repetition in which different section of the sustain segment are repeated one following the other to avoid obvious periodicity in the sustain.

The vibrato speed of a sustain segment can be modified in block 126 by reading out the sequence of pitch, loudness, and spectral fluctuation parameters more or less quickly relative to the original sequence fetched from database 112. In one embodiment of the present invention this modification is accomplished by have a fractional rate of increment through the original sequence. For example, suppose that a segment fetched from 112 comprises a sequence of 10 parameters for each of the pitch, loudness, and harmonics signals. A normal unmodified rate of readout of this sequence would have a rate of increment of 1 through the sequence so that the sequence that is output from block 126 has parameters 1,2,3,4,5,6,7,8, 9,10. To increase decrease the speed of vibrato the increment is reduced to e.g. 0.75. Now the sequence is. 1, 1.75, 2.5, 3.25, 4, 4.75 etc. To select the precise parameter at a given time the fractional part of this incrementing sequence is rounded to allow a specific parameter in the sequence to be selected. The resulting sequence of parameters is 1, 2, 2, 3, 4, 5, etc. As can be seen the vibrato rate is decreased by occasionally repeated an entry in the sequence. If the increment is set greater than 1 then the result will be an occasional deletion of a parameter from the original sequence resulting in an increased vibrato speed. In another embodiment, rather than merely repeating or deleting occasional parameters the parameters are interpolated according to their fractional position in the sequence. So the parameter at 2.5 would consist of a 50% combination of parameter 2 and 3 from the original sequence.

Adjusting the vibrato speed in the manner described above may result in shortening a segment to a point where it is no longer long enough for the desired note output. In that case the techniques for repeating sections of segments described above are employed to lengthen the segment.

Note that the modifications described above affect only the fluctuations applied to the Underlying Spectrum, Pitch, and Loudness which itself is generated directly from pitch and loudness performance controls so that it can maintain a continuous shape over the duration of a note while the fluctuations undergo the modifications described. If the modifications to the fluctuation segments were applied directly to original recordings of samples they would introduce significant audible distortions to the output audio signal 122. This kind of distortion does in fact occur in traditional samplers where e.g. looping of samples generates unwanted periodicity or unnaturalness in the audio output. The approach of the present invention of applying these kinds of modifications to the fluctuation sequence only, avoids this kind of problem.

Harmonic synthesis—which is sometimes referred to as additive synthesis—can be viewed as a kind of "parametric synthesis". With additive or harmonic synthesis, rather than storing time domain waveforms corresponding to note recordings, time-varying harmonic synthesis parameters are stored instead. A variety of parametric synthesis techniques are known in the art. These include LPC, AR, ARMA, Fourier techniques, FM synthesis, and more. All of these techniques depend on a collection of time-varying parameters to represent the time-varying spectrum of sound waveforms rather than time-domain waveforms as used in traditional sampling synthesis. Generally there will be a multitude of parameters—e.g. 10-30 parameters—to represent a short 5-20 millisecond sound segment. Each of these parameters will then typically be updated at a rate of 50-200 times a second to generate the dynamic time-varying aspects of the sound. These time-varying parameters are passed to the synthesizer—e.g. additive harmonic synthesizer, LPC synthesizer, FM synthesizer, etc.—where they are converted to an output sound wave waveform. The present invention concerns techniques for generating a stream of time-varying spectral parameters from the combination of an underlying slowly changing spectrum which is generated from algorithms based on simple input controls such as pitch and loudness and rapidly changes fluctuations which are read from a storage mechanism such as a database. This technique, with all the advantages discussed above, can be applied to most parametric sound representations including harmonic synthesis, LPC, AR, ARMA, Fourier, FM, and related techniques. Although we have described detailed embodiments particularly related to additive harmonic synthesis, the character and advantages of the invention do not depend fundamentally on the parametric representation used.

The invention claimed is:

1. The method of synthesizing sound comprising the steps of:

(a) receiving a control signal related to a sound to be synthesized;

(b) generating a slower varying portion of the sound to be synthesized using stored algorithms applied to the control signal, wherein said slower varying portion refers to slow variations over time in the pitch or amplitude or spectrum of the sound;

(c) generating a quicker varying portion of the sound to be synthesized by retrieving and combining stored segments based upon the control signal, wherein said quicker varying portion refers to quick variations over time in the pitch or amplitude or spectrum of the sound, and wherein said quicker varying portion is to be superimposed on said slower varying portion of the sound to be synthesized;

(d) combining the slower varying portion and the quicker varying portion;

(e) outputting a sound signal based upon the combination of step (d).

2. The method according to claim 1 wherein step (b) generates the slower varying portion based upon underlying frequency spectrum parameters.

3. The method according to claim 2 wherein step (b) further includes the step of generating the frequency spectrum parameters based upon regression parameters conditioned on the pitch and loudness of the sound.

4. The method according to claim 2 wherein step (b) further includes the steps of:

providing slowly varying pitch and slowly varying loudness parameters; and using a prediction algorithm to generate slowly varying spectrum parameters from the slowly varying pitch and loudness parameters.

5. The method according to claim 2 wherein said spectrum parameters include additive synthesis parameters that describe at least slower varying amplitudes of harmonics of said sound to be synthesized.

6. The method of claim 1 wherein said control signal includes a description of the pitch of said sound.

7. The method of claim 6 wherein said control signal includes a MIDI note pitch control signal.

8. The method of claim 1 wherein said control signal includes a description of the loudness of each musical note of said sound.

9. The method of claim 8 wherein said control signal includes a MIDI note velocity signal.

10. The method of claim 1 wherein said control signal includes a description of time-varying loudness.

11. The method of claim 10 wherein said control signal includes a MIDI volume signal.

12. The method of claim 10 wherein said control signal includes an expression continuous control signal.

13. The method of claim 1 wherein generating said quicker varying portion of the sound includes the step of sequentially splicing stored segments into longer segments.

14. The method of claim 13 wherein the step of sequentially splicing segments further includes the step of partially overlapping said segments wherein an earlier segment is faded out while a later segment is faded in, accomplishing a cross-fade splice.

15. The method of claim 1 wherein certain of said stored quicker varying segments represent sustained portions of musical notes, and further including the step of extending sustained portions of musical notes by repeating sections of said segments representing sustained portions.

16. The method of claim 1 wherein certain of said stored quicker varying segments represent sustained portions of musical notes which include vibrato, and further including the step of altering a speed of vibrato in a selected certain segment by reading out said selected certain segment at a chosen different rate relative to the rate associated with the selected certain segment.

17. Apparatus for synthesizing sound comprising:

means for receiving a control signal related to a sound to be synthesized;

a synthesizer including— means for generating a slower varying portion of the sound to be synthesized using stored algorithms applied to the control signal, wherein said slower varying portion refers to slow variations over time in the pitch or amplitude or spectrum of the sound;

means for generating a quicker varying portion of the sound to be synthesized by retrieving and combining stored segments based upon the control signal, wherein said quicker varying portion refers to quick variations over time in the pitch or amplitude or spectrum of the sound, and wherein said quicker varying portion is to be superimposed on said slower varying portion of the sound to be synthesized; and means for combining the slower varying portion and the quicker varying portion; and means for outputting a sound signal based upon the combined slower varying portion and the quicker varying portion.

18. The apparatus of claim 17 wherein the control signal comprises a MIDI signal and the means for receiving the control signal comprises a MIDI preprocessor.

* * * * *